US005606355A

United States Patent [19]

Komatsu

[11] Patent Number: 5,606,355

[45] Date of Patent: Feb. 25, 1997

[54] INK JET RECORDING APPARATUS FOR ADJUSTING RECORDING MODE BASED ON NUMBER OF RECORDING HEADS

[75] Inventor: Hiroki Komatsu, Kanagawa, Japan

[73] Assignee: Fuji Xerox Co., Ltd., Tokyo, Japan

[21] Appl. No.: 177,982

[22] Filed: Jan. 6, 1994

[30] Foreign Application Priority Data

Jan. 7, 1993 [JP] Japan ..... 5-016893

[51] Int. Cl.[6] ..... B41J 2/05

[52] U.S. Cl. ..... 347/60; 347/5; 347/49; 347/14; 347/185

[58] Field of Search ..... 347/5, 6, 14, 40, 347/60, 49, 185, 186

[56] References Cited

U.S. PATENT DOCUMENTS

| | | | |
|---|---|---|---|
| 5,300,969 | 4/1994 | Miura et al. | 347/14 X |
| 5,339,098 | 8/1994 | Nagatomo et al. | 347/5 |

FOREIGN PATENT DOCUMENTS

| | | | |
|---|---|---|---|
| 412459 | 2/1991 | European Pat. Off. | 347/49 |
| 61-249763 | 11/1986 | Japan | 347/14 |
| 62-179945 | 8/1987 | Japan . | |
| 4-28580 | 1/1992 | Japan . | |
| 4-44856 | 2/1992 | Japan . | |

*Primary Examiner*—Mark J. Reinhart
*Attorney, Agent, or Firm*—Finnegan, Henderson, Farabow, Garrett & Dunner, L.L.P.

[57] ABSTRACT

An ink jet recording apparatus wherein a CPU checks the number of recording heads mounted on a carriage, sets a recording mode based on the number of recording heads, determines a combination of a drive frequency and a drive pulse width in accordance with the recording mode, sets drive pulse width data to a head controller, and heats the recording head or heads by a preliminary drive based on the set drive frequency and pulse width.

8 Claims, 4 Drawing Sheets

INK JET RECORDING APPARATUS FOR ADJUSTING RECORDING MODE BASED ON NUMBER OF RECORDING HEADS

BACKGROUND OF THE INVENTION

1. Field of the Invention

The invention relates to ink jet recording apparatus having a single or a plurality of recording heads on a carriage and recording data by jetting ink droplets onto a recording medium from the recording head or heads. More particularly, the invention is directed to preliminary drive of the recording head.

2. Discussion of the Related Art

An ink jet recording apparatus that records data by applying heat to ink by a heater to produce bubbles and jetting the ink onto a recording medium from ink jetting openings of a head by the pressure derived from expansion of the bubbles has been developed.

In such ink jet recording apparatus, the ink is supplied to the front end of a nozzle section at all times. Thus, the ink at the nozzle section is dried at the time the apparatus is inoperative. To prevent the drying of the ink, a cap mechanism for covering the nozzle section is provided so that the nozzle section can be shut off from the outside air. However, even with the cap mechanism, it is difficult to maintain a constant degree of airtightness for a long time. As a result, the moisture and volatile component of the ink are gradually evaporated into the atmosphere from the vicinity of the ink jetting opening of the nozzle when left without covering or the like for a long period of time, changing its physical properties (particularly, its viscosity is increased), thereby making the ink hard to jet. If the normal printing operation is performed under such condition, the ink near the ink jetting opening of the nozzle is not jetted, or is jetted, however, in a direction deviating from the regular course under the normal nozzle drive conditions, thereby addressing the problem of defective printing, in both character and image.

This problem is encountered not only when the apparatus is left for a long period of time, but also when the apparatus is left under low temperatures. During printing, the temperature of the head is controlled optimally, so that stable printing can be ensured. However, as the recording apparatus is left inoperative for a long time, the temperature of the head is gradually decreased. A decrease in the temperature of the head, i.e., a decrease in the temperature of the ink increases the viscosity of the ink. As a result, even when the apparatus is left under lower temperatures, the same problem of poor printing in both character and image is addressed similarly to the case where the apparatus is left inoperative for a long time. In addition, the ink jetting amount is decreased, which causes the problem of inadequate image density or the like.

As is apparent from the above, it is ideal for the ink jet recording apparatus that the physical properties of the ink can be maintained stable when the apparatus is left inoperative over a long period of time. To achieve this, various methods of avoiding defective printing by attempting to improve head drive control have been developed. Proposed is a control involving the steps of driving the head on a preliminary basis by such a drive pulse as not to jet the ink before printing so that the apparatus can start printing data after the ink is ready to be jetted. For example, Japanese Patent Unexamined Publication No. Hei 4-28580 discloses a method of warming an apparatus up by using a pseudo print signal and a drive pulse, the pseudo print signal being a signal shorter than the genuine print signal. This method is not, however, applied to ink jet recording apparatuses.

Further, Japanese Patent Unexamined Publication No. Sho 62-179945 discloses a method of easily optimizing the preliminary drive operation by setting a drive pulse cycle and a drive pulse width of the recording head as the number of clocks and controlling the preliminary drive of the head based on the set number of clocks.

However, with these methods, the nozzle must be driven for a relatively large number of times to heat the head to a predetermined temperature under lower temperatures. Further, if the preliminary drive is effected with such a drive pulse as riot to jet ink as described above, the drive pulse width is limited to comparatively small values. This may increase the preliminary drive time.

It is also conceivable to shorten the time required for preliminary drive by decreasing the drive pulse cycle. In addition to the above-mentioned publications, Japanese Patent Unexamined Publication No. Hei 4-44856, e.g., discloses a method of decreasing the waiting time before the recording head is heated to a predetermined printable temperature after turning the power on by applying an electrical signal whose frequency is higher than the recording frequency. Such a method of using the higher frequency as the drive pulse allows quick and stable printing with shortened preliminary drive.

However, the above-mentioned method of using the drive pulse whose frequency is higher than the recording frequency not only burdens the recording head due to high frequency, but also elevates the cost of power with high current consumption by the power supply. The increase in the consumed current by the power supply imposes another problem if the number of recording heads mounted on the carriage is increased. Since the capacity of the power supply is limited in small recording apparatuses, the currently used power supply capacity may not be sufficient to meet control requirements in some cases. For this reason, preliminary drive that is optimal to an individual system configuration must be designed and effected.

SUMMARY OF THE INVENTION

The invention has been made in view of the above circumstances. Accordingly, the object of the invention is to provide an ink jet recording apparatus capable of effecting quick preliminary heating without increasing the existing capacity of a power supply.

To achieve the above object, the invention is applied to an ink jet recording apparatus having a single or a plurality of recording heads on a carriage and recording data by jetting ink droplets onto a recording medium from the recording head or heads. Such apparatus includes a control means for effecting preliminary heating by setting a drive frequency and a drive pulse width of the recording head or heads in accordance with the number of recording heads for which the preliminary heating is effected.

With respect to the setting of the drive frequency and the drive pulse width, it may be so designed that a plurality of combinations of the drive frequency and the drive pulse width are stored in advance and an optical combination can be selected therefrom. Further, the drive frequency and the drive pulse width may be set in consideration of environmental temperatures.

According to the invention, preliminary heating is effected by setting the drive frequency and the drive pulse width of the recording head in accordance with the number of recording heads mounted. That is, in the case of a large number of recording heads, the drive frequency and the drive pulse width are set so that drive current to be applied to each recording head is decreased to such an extent as not to exceed the existing capacity of the power supply in total. As a result, even if the number of recording heads is increased, preliminary drive optimal to the existing capacity of the power supply can be effected, thereby allowing a small recording apparatus to achieve optimal preliminary drive without using a power supply of larger capacity. Further, in the case of a small number of recording heads, the drive frequency and the drive pulse width are set to such an extent as to allow the recording heads to be heated as quickly as possible. Accordingly, high-speed preliminary drive can be effected within the existing capacity of the power supply.

BRIEF DESCRIPTION OF THE DRAWINGS

The accompanying drawings, which are incorporated in and constitute a part of this specification, illustrate embodiments of the invention and, together with the description, serve to explain the objects, advantages and principles of the invention. In the drawing.

DETAILED DESCRIPTION OF THE PREFERRED EMBODIMENT

Figure 1:
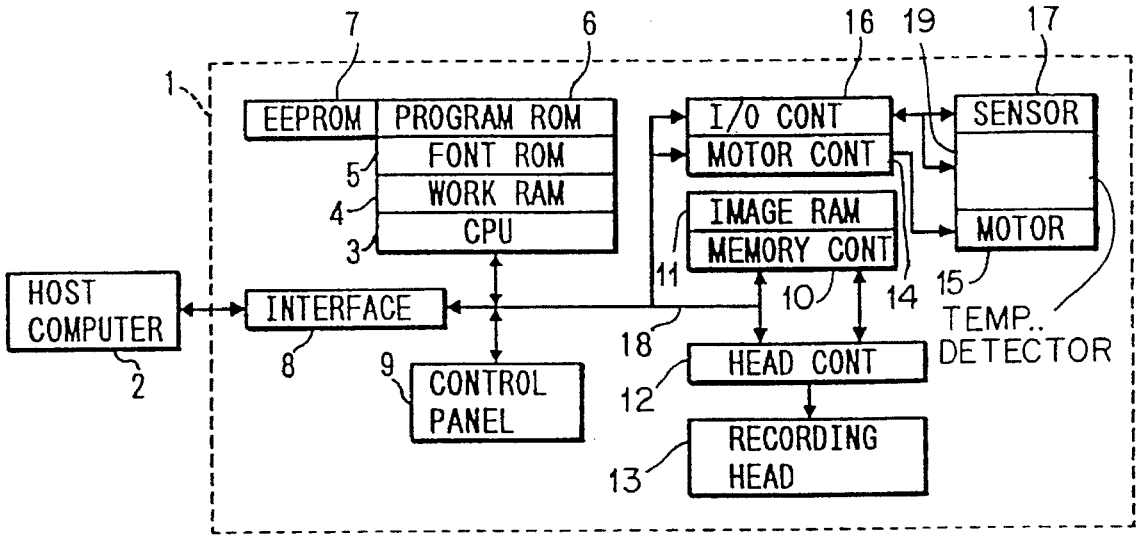
FIG. 1 is a configurational diagram showing an ink jet recording apparatus, which is an embodiment of the invention.

FIG. 1 is a configurational diagram showing an ink jet recording apparatus, which is an embodiment of the invention. In FIG. 1, reference numeral 1 designates an ink jet recording apparatus; 2, a host computer; 3, a CPU; 4, a work RAM; 5, a font ROM; 6, a program ROM; 7, EEPROM; 8, an interface; 9, a control panel; 10, a memory controller; 11, an image RAM; 12, a head controller; 13, a recording head; 14, a motor controller; 15, a motor; 16, an I/O controller; 17, sensors; and 18, a common bus.

Ink jet recording apparatus 1 is connected to host computer 2, and exchanges data therewith. CPU 3 is connected to work RAM 4, font ROM 5, program ROM 6, and EEPROM 7, and processes data by referring to set values, e.g., correction data for producing higher-definition images, stored in EEPROM 7 in accordance with programs stored in program ROM 6. CPU 3 is connected also to common bus 18, so that CPU 3 can control various parts within ink jet recording apparatus 1 through common bus 18. Work RAM 4 is used not only as a work memory area for CPU 3 but also as an area for storing data or the like within various systems of the apparatus. Font ROM 5 stores characters to be printed in image form. Program ROM 6 stores programs for commanding the operation of CPU 3. EEPROM 7 is a nonvolatile memory, and stores various set values such as system operation modes since the stored contents are preserved thereby even if the apparatus is turned off. Some of these data may be set through control panel 9.

Interface 8 is connected to both common bus 18 and host computer 2, and directly communicates with host computer 2. Control panel 9 is connected to common bus 18, and receives various inputs from a user and displays various modes and messages to the user.

Memory controller 10 is connected to image RAM 11, common bus 18, and head controller 12, and controls image RAM 11. Image RAM 11 stores data to be recorded in image form. Image RAM 11 can be divided into areas respectively dedicated to a plurality of recording heads.

Head controller 12 is connected to recording head 13, common bus 18, and memory controller 10, and controls recording head 13. Head controller 12 is responsible for at least control over the ink jetting timing of each nozzle on each recording head and the drive time of the recording head. Head controller 12 may substitute part of the control effected by CPU 3. Recording head 13 has a plurality of heads, each having N nozzles. For example, four recording heads for black K, cyan C, magenta M, end yellow Y are provided for color printing.

Motor controller 14 is connected to motor 15 and common bus 18, and controls motor 15. Motor 15 causes a carriage mounted on recording head 13 to move relative to a recording medium, e.g., a recording sheet. I/O controller 16 is connected to various sensors 17, a temperature detector 19, and common bus 18, and controls sensors 17 and receives sense data therefrom. Sensors 17 include a sheet tail end sensor, a sheet width sensor, and an ink amount sensor.

Common bus 18 is connected to CPU 3, interface 8, control panel 9, memory controller 10, head controller 12, motor controller 14, and I/O controller 16, and transmits various data and control signals.

While the above-described configuration is functionally divided, a modification for forming image RAM 11 and work RAM 4 of a single RAM may be applicable.

An operation of the system shown in FIG. 1 will be described. CPU 3 processes data by referring to set values or o the like stored in EEPROM 7 in accordance with the programs stored in program ROM 6. CPU 3 uses work RAM 4 in such processing. The set values or the like stored in EEPROM 7 are inputted from control panel 9. CPU 3 obtains data from sensors 17 through I/O controller 16, and checks if the apparatus is ready to record data, makes an alignment for recording by giving motor controller 14 a command for moving the carriage and feeding the recording sheet, or performs like operations.

When data to be recorded, such as image data, character codes, or the like, is applied from host computer 2, such data is received by interface 8. Interface 8 then transmits the received data to work RAM 4. CPU 3 converts the received data into printable image data, e.g., into bit map data, in accordance with a print format. For example, if the recorded data is a character code, then CPU 3 converts the received data into image data for such character by using front ROM 5. The converted image data is then stored in image RAM 11 through memory controller 10.

When the image data has been stored, CPU 3 detects temperatures using temperature detecting elements contained in the printer body as well as in various heads. Based on the detected temperatures, CPU 3 drives the respective recording heads on a preliminary basis to heat the heads to a range of temperatures in which stable ink jetting characteristics are obtained, because if the head temperature is low immediately before printing, the ink jetting characteristics are impaired. CPU 3 counts the number of recording heads mounted on the carriage and determines a combination of the drive frequency and the drive pulse width based on such number. CPU 3 then sets the drive pulse width data to head controller 12 and drives the recording heads on a preliminary basis for heating. The combination of the drive frequency and the drive pulse width can be corrected on the basis of the detected temperatures of the recording heads and the printer body.

As described above, the preliminary drive time can be shortened by increasing both the drive frequency and the drive pulse width while increasing the consumed current on the part of the power supply. However, such preliminary drive entails increased load and cost of the power supply. Consequently, to determine preliminary drive optimal to a system configuration, the load on the part of the power supply as well as the cost of the power supply must be considered. For a system with a large number of heads, current applied to each recording head must be decreased to limit the total current consumption to a level below the existing capacity of the power supply, whereas for a system with a small number of heads, the time required for preliminary drive is shortened with per head current consumption increased while leaving the existing capacity of the power supply unchanged.

Let us take a look at an example. A color printer can mount four recording heads for black K, cyan C, magenta M, and yellow Y. If the printer has only the recording head for black K, then only the recording head for black K is heated. In this case, the frequency for driving the recording head is set to a higher value and the drive pulse width is set to a larger value so that current applied to the recording head for black K can be increased compared with the case where four recording heads are mounted. Thus, by setting such drive control as to reduce the heating time, the preliminary drive time can be shortened. In contradistinction therewith, if the four recording heads are mounted, the drive frequency of each recording head is set to a lower value and the drive pulse width, to a smaller value so that the consumed current per head is decreased to thereby limit the total current to a level below the existing capacity of the power supply. In this way, the mounted recording heads can be driven on a preliminary basis to be heated to predetermined temperatures by setting the drive frequency and the drive pulse width for each recording head based on the number of recording heads mounted.

Then, CPU 3 scans while requesting motor controller 14 to move the carriage. The carriage having recording head 13 has an encoder for generating print timings, and a print timing corresponding to a scanning speed of the carriage is fed to CPU 3 as well as to head controller 12. CPU 3 determines a print start position based on such timing, and supplies a print permitting gate signal to head controller 12. Upon reception of the print permitting gate signal and the print timing signal, head controller 12 outputs a head drive signal to recording head 13. When a single round of scanning has been completed by successively following these steps, memory controller 10 generates an interrupt, and applies such interrupt to CPU 3. Upon reception of the interrupt, CPU 3 requests motor controller 14 to feed the recording medium as much as a print width and cause the carriage to scan again.

The printing operation involving a plurality of rounds of scanning is performed until the printing on the recording medium in the recording medium feed direction is completed. At a timing before each round of scanning is started, the temperature of the head and the environmental temperatures are detected to set the head drive pulse and the drive operation mode.

When printing on a sheet of recording medium has been completed in the above way, CPU 3 requests motor controller 14 to not only discharge the recording medium, but also move the carriage to a position at which a cap member for covering the nozzle section is disposed and cap the cap member to cause the apparatus to stay in a standby position until a next print operation.

The above-mentioned operations complete the printing of a single page of the recording medium.

Figure 2:
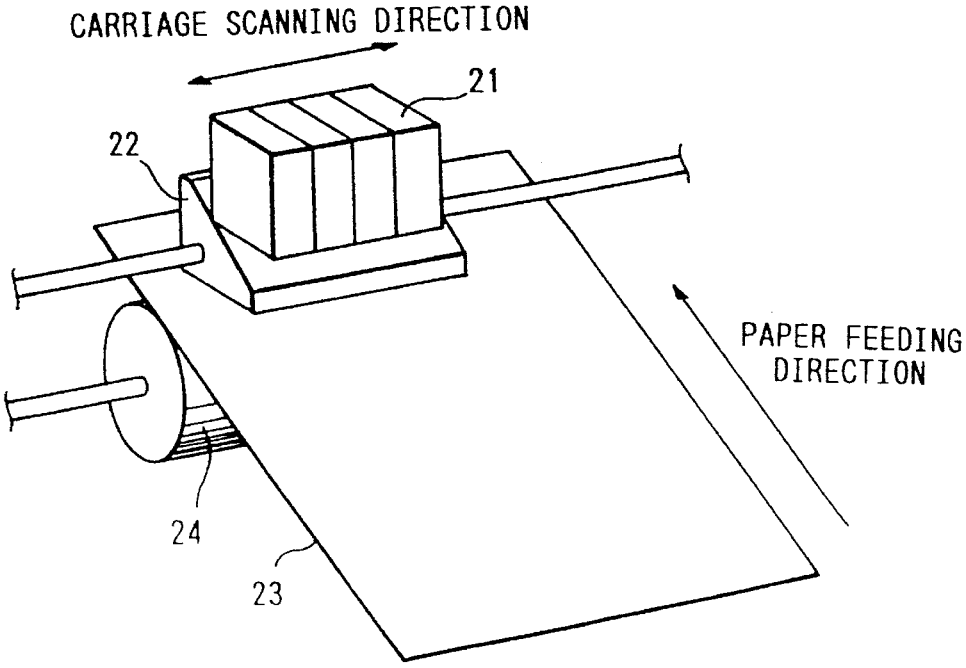
FIG. 2 is a schematic configurational diagram showing parts around a carriage in the embodiment shown in FIG. 1.

FIG. 2 is a schematic configurational diagram showing parts around the carriage in the ink jet recording apparatus shown in FIG. 1. In FIG. 2, reference numeral 21 designates a recording head unit; 22, the carriage; 23, a recording medium; and 24, a transport roller. Carriage 22 carries a single or a plurality of recording head units 21. Recording head units 21 are designed so as to be releasably mounted on carriage 22 individually or collectively. Each recording head unit 21 has a plurality of nozzles. Printing is effected by jetting ink droplets from each nozzle while causing carriage 22 to scan in a horizontal direction. Such printing is effected to form an image while superposing ink dots by jetting ink droplets from each recording head unit 21 when a plurality of recording head units 21 are mounted on carriage 22. By using four recording head units for, e.g., black, cyan, magenta, and yellow as the plurality of recording head units 21, color images can be formed.

When a single round of scanning is completed by carriage 22, recording medium 23 is fed as much as a predetermined distance by transport roller 24. By repeating the above operation, a single sheet of printing can be completed.

While the movement of the recording medium in the vertical direction is effected by moving the recording medium itself in this embodiment, carriage 22 may be moved instead. The moving distance may be set to a single line, a predetermined number of lines, or a total amount of blank to be scanned. Further, the moving distance for the feeding of the recording medium or for the positioning of the recording medium so that the recording medium gets ready for recording in accordance with a preset format may be varied by a command from CPU 3.

Figure 3:
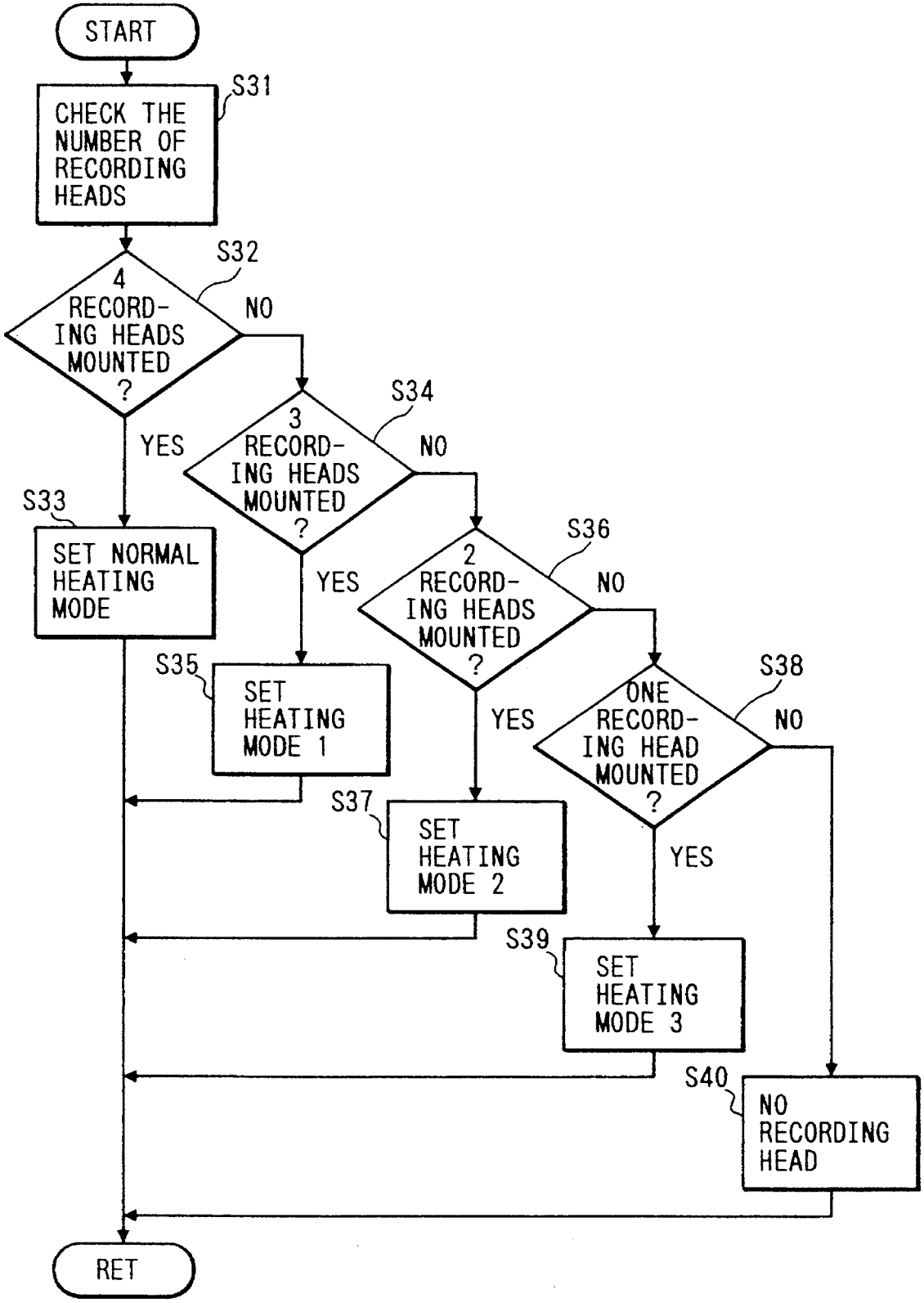
FIG. 3 is a flowchart illustrative of the operation of setting a combination of a drive frequency and a drive pulse width at the time of preliminary drive according to the number of heads mounted.

FIG. 3 is a flowchart illustrative of the operation of setting a combination of the drive frequency and the drive pulse width at the time of preliminary drive. As described above, the preliminary drive is effected by setting a combination of the drive frequency and the drive pulse width in accordance with the number of recording heads mounted. Shown in FIG. 3 is an example of a recording apparatus capable of mounting four recording heads.

The number of recording heads mounted is checked in Step S31. If it is found that the number of recording heads mounted is four in Step S32, a normal heating mode is set in Step S33. If it is found that the number of recording heads mounted is three in Step S34, then a heating mode 1 whose heating time is shorter than the normal heating mode is set in Step S35. If it is found that the number of recording heads mounted is two in Step S36, then a heating mode 2 whose heating time is shorter than heating mode 1 is set in Step S37. If it is found that the number of recording heads mounted is one in Step S38, then a heating mode 3 whose heating time is shorter than heating mode 2 is set in Step S39. In cases other than the above, the processing for a case where no recording head is mounted is executed in Step S40.

While the heating mode for the system having four recording heads is termed as being normal as the preliminary drive time in the above setting, the word "normal" is used only for convenience; any mode can be termed as being "normal." In the above example, the system having four recording heads consumes the least current for each of the four recording heads, thus making the preliminary drive time long. The system having only one recording head can consume larger current per head, thus making the preliminary drive time shorter.

Figure 4:
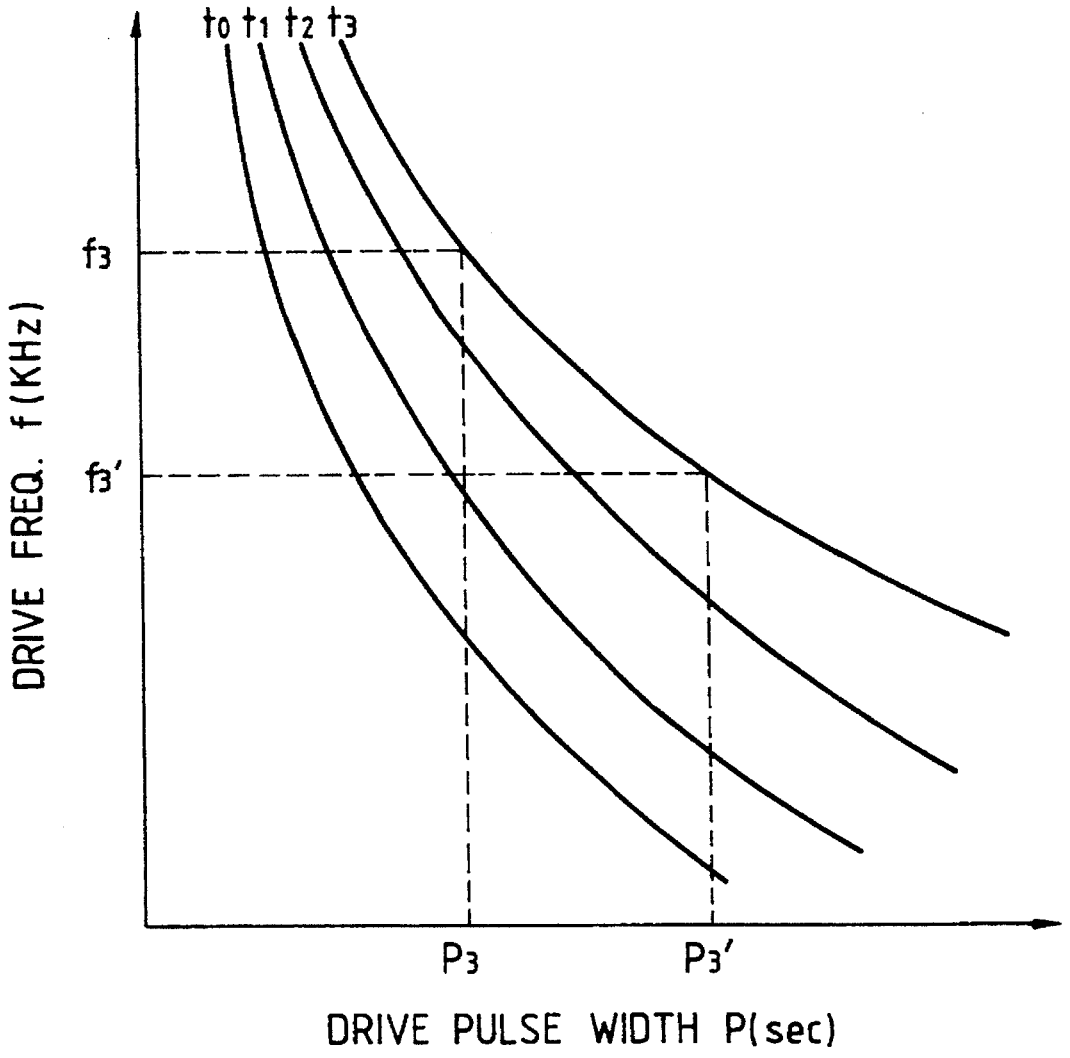
FIG. 4 is a graph showing a relationship among the drive pulse width, the drive frequency, and the temperature increasing time.

FIG. 4 is a graph showing a relationship among the drive pulse width, the drive frequency, and the heating time. Assuming that the heating times for the normal heating mode, heating mode 1, heating mode 2, and heating mode 3 are t0, t1, t2, t3 (sec), respectively, their relationship becomes t0>t1>t2>t3. In this case, the relationship between the heating time t (sec) and the drive frequency f (kHz) for increasing the temperature of each head by ΔT (°C.) is as shown in FIG. 4.

Let it be assumed here that heating mode 3 is, e.g., selected; in other words, the number of recording heads is one. In this case, a drive frequency f3 (kHz) and a drive pulse width P3 (sec) on the curve of t3 (sec) in FIG. 4 are selected so that the desired heating can be achieved within heating time 3 (sec). CPU 3 sets pulse data for generating drive pulse width P3 to head controller 12. The same heating can be completed within heating time 3 (sec) by selecting a drive frequency f3' and a drive pulse width P3' on the curve. Accordingly, a plurality of combinations of the drive frequency and the drive pulse width are available for heating the head within a single heating time t (sec). Appropriate combinations can be defined for proper selection. The upper limit of the drive frequency is determined by the characteristic of the head, whereas the upper limit of the drive pulse width is defined in terms of not jetting the ink. The drive frequency and the drive pulse width can be appropriately set to values below such limits. For example, only the drive pulse width is varied in accordance with the respective heating modes while fixing the drive frequency, or conversely, the drive frequency can be varied with the drive pulse width fixed.

The same applies to the heating modes other than heating mode 3. If the normal heating mode is selected; i.e., if four recording heads are mounted, the drive frequency and the drive pulse width can be set based on FIG. 4 so that the heating can be completed within a heating time t0 (sec). The same applies when heating mode 1 or heating mode 2 is selected.

As described above, the drive mode is selected in accordance with the number of recording heads mounted, and a desired combination of the drive frequency and the drive pulse width for the set drive mode is then set.

While the recording head heating mode is selected by checking the number of recording heads mounted in the above-mentioned embodiment, such mode may be selected in other ways. For example, a mode setting means is arranged on control panel 9 in FIG. 1, e.g., a mode selector switch is arranged on the panel, so that a user can select a desired mode directly through the panel in the case where four recording heads for black, cyan, magenta, and yellow, are mounted. Selectable modes may be, e.g., a "black only" print mode; a "color only" print mode; and a "particular color only" print mode. If, e.g., the user wishes to print data using only black, then the "black only" print mode is selected. In this case, the black head heating mode is selected from the modes preset in EEPROM 7 of FIG. 1. That is, similar to the case where only the black head is mounted in the above-mentioned embodiment, the black head heating mode is based on such control as to set the drive frequency to a higher value and the drive pulse width to a larger value for driving the black head to thereby reduce the head heating time. This control is effected by a flow of steps shown in FIG. 5. It is checked if the color specification is made for printing in Step S41. If the color specification has been made, Step S42 will be executed. If the color specification has not been made, Step S51 is executed to start such control corresponding to the number of heads mounted as shown in FIG. 3. The respective heating modes are set in EEPROM 7 in advance and are selected every time such selection is necessary. The number of colors, from one to four, is checked in Steps S42 to S48. If none of the colors is used, the heating mode selecting operation is not performed in Step S50. The respective heating modes are selected in accordance with Steps S42 to S48.

While the case where the preliminary drive is effected for all the recording heads mounted has been described above, the preliminary drive is not necessary for heads not used.

Figure 5:
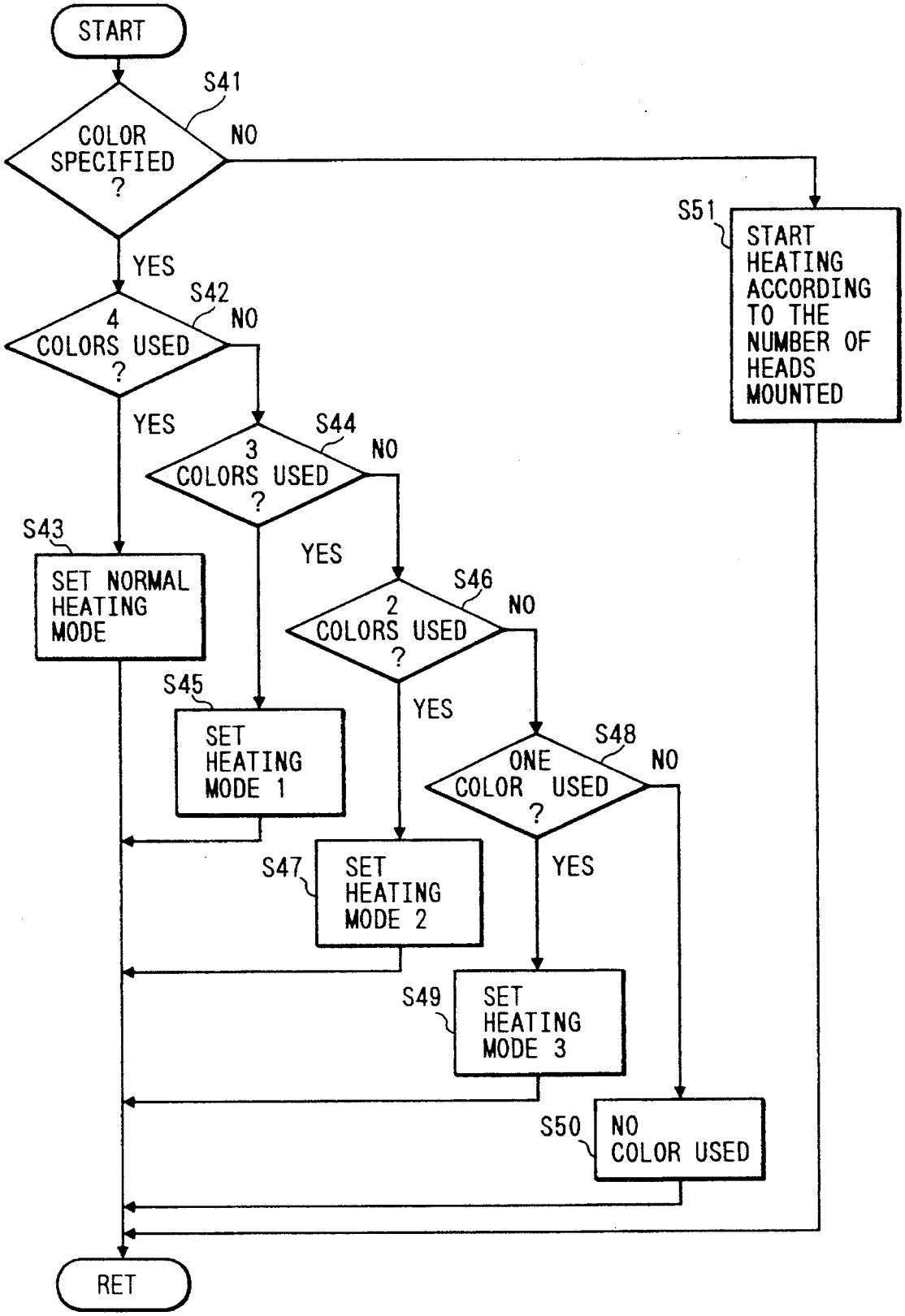
FIG. 5 is a flowchart illustrative of the operation of setting a combination of a drive frequency and a drive pulse width at the time of preliminary drive according to the color specification.

That is, a detection signal is used as the color specification signal referred to in FIG. 5. More specifically, a single page of print data from the host computer is stored in a buffer memory, and CPU 3 is caused to detect the recording head or heads to be used for printing such single page based on the print data belonging to such single page, whereby the detection signal can be used as the color specification signal referred to in FIG. 5. This arrangement allows the head heating mode to be determined automatically in accordance with print data. As a result, the preliminary drive time can be further shortened compared with the preliminary drive for all the recording heads mounted.

Since the power consumption is determined by the number of recording heads if the combination of the drive frequency and the drive pulse width is set in accordance with the drive mode, it is conceivable that the preliminary drive time is fluctuated by environmental temperatures. To overcome this problem, the drive frequency and the drive pulse width may be corrected in accordance with environmental temperatures such as temperatures of the recording apparatus and of the recording heads.

As is apparent from the foregoing, the invention is characterized as allowing the head or heads to be driven on a preliminary basis by setting the drive frequency and the drive pulse width in accordance with the number of recording heads while considering the existing capacity of the power supply of the recording apparatus. Therefore, high-speed preliminary drive suitable for the recording apparatus can be effected without increasing the existing capacity of the power supply of the recording apparatus.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular used contemplated. It is intended that the scope of the invention be defined by the claims appended hereto, and their equivalents.

What is claimed is:

1. An ink jet recording apparatus, comprising:

a plurality of recording heads;

means for determining those of said plurality of record heads to be used for a printing operation;

preliminary heating means for preliminarily heating said determined recording heads using a voltage having a drive frequency and a pulse width; and preliminary heating control means for setting the drive frequency and the pulse width of said voltage according to a number of said determined recording heads.

2. An ink jet recording apparatus as claimed in claim 1, wherein said determinating means comprises means for discriminating print data.

3. An ink jet recording apparatus as claimed in claim 1, wherein said determining means comprises means for discriminating print data.

4. An ink jet recording apparatus for recording data by jetting ink droplets onto a recording medium, said apparatus comprising:

a carriage;

at least one recording head mounted on said carriage;

preliminary heating means for heating said at least one recording heat using a voltage having a drive frequency and a pulse width; and control means for controlling the preliminary heating means by setting the drive frequency and the drive pulse width of said voltage according to a number of said recording heads mounted on said carriage.

5. An ink jet recording apparatus as claimed in claim 4, wherein said control means sets said drive frequency and said drive pulse width according to a number of ink colors.

6. An ink jet recording apparatus for recording data by jetting ink droplets onto a recording medium, said apparatus comprising:

a carriage;

at least one recording head mounted on said carriage;

means for storing print data for a single page;

means for detecting at least one recording head to be used for printing the single page according to the print data stored in said storing means;

preliminary heating means for heating said detected at least one recording head by applying a voltage; and control means for controlling the preliminary heating means by setting a drive frequency and a drive pulse width of said voltage.

7. An ink jet recording apparatus as claimed in claim 6, wherein said control means automatically sets a head heating mode according to said print data.

8. An ink jet recording apparatus for recording data by jetting ink droplets onto a recording medium, said apparatus comprising:

a carriage;

at least one recording head mounted on said carriage;

means for detecting a number of recording heads mounted on said carriage; and means for setting a head heating time mode according to the number of recording heads detected by said detecting means.

* * * * *

UNITED STATES PATENT AND TRADEMARK OFFICE

CERTIFICATE OF CORRECTION

PATENT NO. : 5,606,355

DATED : February 25, 1997

INVENTOR(S) : Hiroki KOMATSU

It is certified that error appears in the above-indentified patent and that said Letters Patent is hereby corrected as shown below:

Claim 2, column 9, lines 9-11, delete claim 2 in its entirety and insert therefor --2. An ink jet recording apparatus as claimed in claim 1, wherein said determining means comprises a switch.--.

Signed and Sealed this

Fifteenth Day of July, 1997

Bruce Lehman

*Attest:*

BRUCE LEHMAN

*Attesting Officer*

*Commissioner of Patents and Trademarks*